US007415735B2

(12) United States Patent
Erickson et al.

(10) Patent No.: US 7,415,735 B2
(45) Date of Patent: Aug. 26, 2008

(54) GRIP ENHANCING GLOVE AND METHOD FOR MAINTAINING A GRIP THAT ENABLES A USER TO MAINTAIN A PROLONGED GRIP WITHOUT INCURRING UNDESIRABLE EFFECTS

(75) Inventors: Spencer K. Erickson, Ammon, ID (US); V. Gregory Lorenzon, Holladay, UT (US)

(73) Assignee: Erickson & Lorenzon Enterprises, LLC, Salt Lake City, UT (US)

( * ) Notice: Subject to any disclaimer, the term of this patent is extended or adjusted under 35 U.S.C. 154(b) by 0 days.

(21) Appl. No.: 11/423,902

(22) Filed: Jun. 13, 2006

(65) Prior Publication Data

US 2008/0000010 A1 Jan. 3, 2008

(51) Int. Cl.
*A41D 19/00* (2006.01)

(52) U.S. Cl. ..... 2/163

(58) Field of Classification Search ..... 2/16, 2/20, 21, 161.6, 163; 482/44, 47; 473/205
See application file for complete search history.

(56) References Cited

U.S. PATENT DOCUMENTS 2,737,663 A * 3/1956 Harris ..... 2/161.6
3,347,547 A * 10/1967 Hynes ..... 482/47
3,408,657 A * 11/1968 Gallagher ..... 2/159
3,944,220 A 3/1976 Fasano
4,051,553 A 10/1977 Howard
4,675,914 A 6/1987 Mitchell
4,796,306 A 1/1989 Mitchell
5,022,094 A * 6/1991 Hames et al. ..... 2/163
5,373,585 A * 12/1994 Wiggins ..... 2/159
5,435,013 A 7/1995 Davis
5,538,488 A * 7/1996 Villepigue ..... 482/47
5,628,069 A 5/1997 Ebert
5,697,103 A * 12/1997 Wiggins ..... 2/159
5,715,539 A 2/1998 Benecki et al.
6,553,576 B1 * 4/2003 Knapp ..... 2/161.6
6,658,669 B1 * 12/2003 Addington et al. ..... 2/161.1
2005/0193465 A1 * 9/2005 Salvitti ..... 2/161.5
2006/0247102 A1 * 11/2006 Kupferman ..... 482/44

* cited by examiner

*Primary Examiner*—Katherine Moran
(74) *Attorney, Agent, or Firm*—Holland & Hart LLP

(57) ABSTRACT

A glove with enhanced gripping capabilities that makes maintaining a grip for a user, less taxing and less fatiguing for the user's hand and forearm muscles. More particularly, a grip-enhancing glove, and method for maintaining a grip, which enables a user to maintain a prolonged grip without incurring undesirable effects.

12 Claims, 8 Drawing Sheets

GRIP ENHANCING GLOVE AND METHOD FOR MAINTAINING A GRIP THAT ENABLES A USER TO MAINTAIN A PROLONGED GRIP WITHOUT INCURRING UNDESIRABLE EFFECTS

BACKGROUND

1. Field of Invention

The present invention relates to a glove with enhanced gripping capabilities that makes maintaining a grip for a user, less taxing and less fatiguing for the user's hand and forearm muscles. More particularly, the present invention entails a grip-enhancing glove and a method for maintaining a grip that enables a user to maintain a prolonged grip without incurring undesirable effects, as described herein.

2. Background and Related Art

Many sports and other activities require a participant to maintain a prolonged grip around a generally cylindrical object, such as a handle bar. Unfortunately, maintaining such a grip often fatigues the sports participant or user's hand and forearm muscles. In fact, to create a strong grip requires great strength from multiple muscles. Specifically, to form a grip, the flexor muscles of the forearm pull the flexor tendons in the hand. The large amount of tension generated in these muscles and forearm causes hypertrophy, which occurs when the muscles grow in size and fictional capacity to meet the demands placed on it. Thus, prolonged grips and the inability to maintain them becomes a limiting factor for users participating in activities requiring prolonged grips.

Moreover, certain activities cause premature hand and muscle fatigue and consequent grip failure. Grip failure occurs where there is constant direct pressure countering the grip, which eventually forces the grip to open. For example, if a user is strength training and using either a hanging bar or lifting a dumbbell, pressure is continually exerted on the palm of the hand. Eventually, if the force is big enough, it causes the hand to open and the grip to release. Another example involves a user who grips a motorcycle handlebar. While riding, a motorcycle rider, must exert great forces in order to grip and maintain the grip. Specifically, the rider exerts force to hold the bar, must endure the vibration of the bar, and maintain a steady grip for long distance rides. The rider must also vary the pressure to which he or she grips the handlebar, further fostering muscle fatigue.

Many users wear gloves to alleviate the wear and tear on their hands that results from users making prolonged grips. Gloves with non-slip surfaces also provide enhanced gripping capabilities and greater grip strength. However, the problem remains unresolved, and there exists a need, for a glove or method for maintaining a prolonged grip, which enables a user to maintain a grip for an extended period of time, without incurring the undesirable effects of hand wear and tear and hand and forearm muscle fatigue. Moreover, there exists the need for a glove that postpones hand, forearm and muscle fatigue and allows a user to maintain a grip for greater lengths of time and under greater pressures than are possible with available gloves.

SUMMARY AND OBJECTS OF THE INVENTION

Some embodiments of the present invention provide a glove that can be manipulated into a grip position so that a user wearing such a glove is able to maintain the grip for a prolonged period of time, without incurring normally-occurring fatigue resulting from such a prolonged grip.

In a preferred embodiment of the present invention, a glove is provided that has a hand-receiving area, a palmar side, a dorsal side, finger compartments for receiving the user's fingers and cords running either longitudinally and bilaterally along the sides and tip of each finger compartment, or just longitudinally along the palmar-region of the finger compartments. The cords are either integrally connected to the finger compartments, or they are able to move relative to the finger compartments. The cords may also be connected to the finger compartments or to the glove by loop-shaped elements. These loop-shaped elements need not necessarily be circular or looped, yet should be shaped in a way as to receive the generally cylindrically-shaped cords within them. The cords congregate at or around either the wrist or palm region into a gathering and tightening feature. This gathering and tightening feature receives the cords and enables a user to pull the cords downward, through the gathering and tightening feature, toward the wrist thereby drawing the fingers and finger compartments into a grip. The user may then secure the cords by activating the tightening mechanism in the gathering and tightening feature. Once the cords are secure, the fingers are precluded, without user manipulation, from opening into their extended state, and thus, a grip is formed and maintained.

The foregoing description entails the preferred embodiment of the present invention.

In some embodiments of the present invention, where the cords run longitudinally along the palmar side of the finger compartments, they are connected to the finger compartments by horizontal straps as well the loop-shaped elements. These horizontal straps help optimally connect the cords to the glove.

In other embodiments of the present invention, the gathering and tightening feature is located in the palm area of the hand, in other embodiments the dorsal area of the hand, while in other embodiments, it is located below the wrist. In some embodiments, the looped-shaped element is located on each diametric side of the finger compartment at the metacarpophalangeal region.

In some embodiments, the cords are integrally connected to the finger compartments and do not move relative to the glove or the finger compartments. In other embodiments, the loop-shaped elements are interspersed along the finger compartments and the tip of the finger compartments. In this embodiment, the cords are movable relative to the finger compartments. However, in both foregoing embodiments, the cords congregate at a point below the finger compartments and the gathering and tightening feature.

In some embodiments of the present invention the cords are pre-tensioned. That is, in some embodiments of the present invention, the cords have a predetermined strength or rigidity, while in other embodiments, the cords are more flexible. The strength or rigidity of the cords depends on the needs of the user. In some embodiments, the cords may be removed and replaced with cords having different strengths or rigidities.

In other embodiments, some cords may be tightened while others are not, thus varying the amount of fingers and compartments that are forced into the grip.

In some embodiments, the gathering and tightening feature is fabric that receives the cords, wherein the user can somehow secure the cords within the feature or after so that it is precluded from retreating from within the feature and becoming not secure so that the grip is not maintained. In other embodiments, the gathering and tightening feature is a solid mechanism that can secure the cords.

In some embodiments of the present invention, the glove described herein can be used by those who participate in various sports that require a strong, but prolonged grip, such as: mountain-biking; skiing; water-skiing; wind-surfing; or virtually any other sport that requires the hand to grip something.

In another embodiment, the palmar side of the glove is lined with an elastic material that is sewn into place, which causes pre-curving of the glove so that when the hand is inserted into the glove, it is forced into a gripping position, yet the hand can still extend and open as in the other embodiments. The elastic material may be made of different strengths for varying user needs. In some embodiments, any material known to one skilled in the art may be used that causes pre-curving of the glove into a gripping position and also allows for hand extension.

These and other embodiments of the present invention will become more fully apparent from the following description, drawings, and claims. Other embodiments will likewise become apparent from the practice of the invention as set forth hereafter.

BRIEF DESCRIPTION OF THE DRAWINGS

The foregoing and other objects and features of the present invention will become more fully apparent from the accompanying drawings when considered in conjunction with the following description and appended claims. Although the drawings depict only typical embodiments of the invention and are thus, not to be deemed limiting of the invention's scope, the accompanying drawings help explain the invention in added detail.

FIG. 1 shows the glove, as described herein, on a user's hand.

FIG. 2(*b*) again depicts a transparent view of the glove while displaying a non-transparent profile of the cord running alongside the user's finger.

DETAILED DESCRIPTION OF THE INVENTION

It is emphasized that the present invention, as illustrated in the figures and description herein, can be embodied in other forms. Thus, neither the drawings nor the following more detailed description of the various embodiments of the system and method of the present invention limit the scope of the invention. The drawings and detailed description are merely representative of the particular embodiments of the invention; the substantive scope of the present invention is limited only by the appended claims. The various embodiments of the invention will best be understood by reference to the drawings, wherein like elements are designated by like alphanumeric character throughout.

Figure 1:
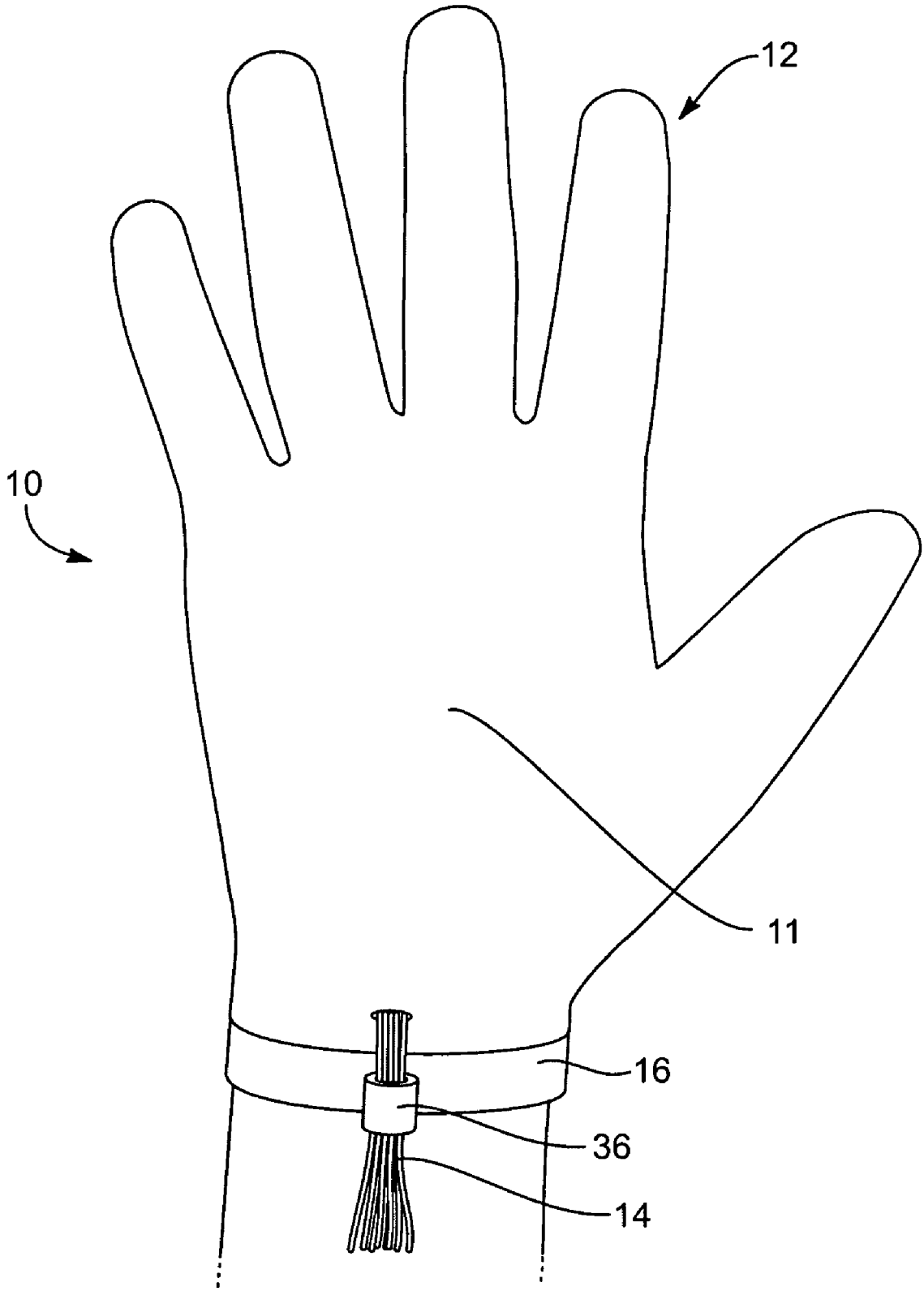
FIG. 1 depicts one view of one embodiment of the present invention. Specifically.

With reference now to the accompanying drawing, FIG. 1 depicts one view of one embodiment of the present invention. Specifically, FIG. 1 shows a user's hand 12 in a glove 10, which is the subject of the present invention. This view is of the palmar side of the hand 12. In this embodiment, the cords 14 that are integrally connected to the glove 10, dangle below the wrist 16. However, in other embodiments they might not be exposed or covered by a gathering and tightening feature 36. (shown later) This gathering and tightening feature 36 may comprise a fastener, a lock, or a patch of fabric with securing capabilities, which precludes the cords 14 from becoming unsecured without activation from the user.

Figure 2B:
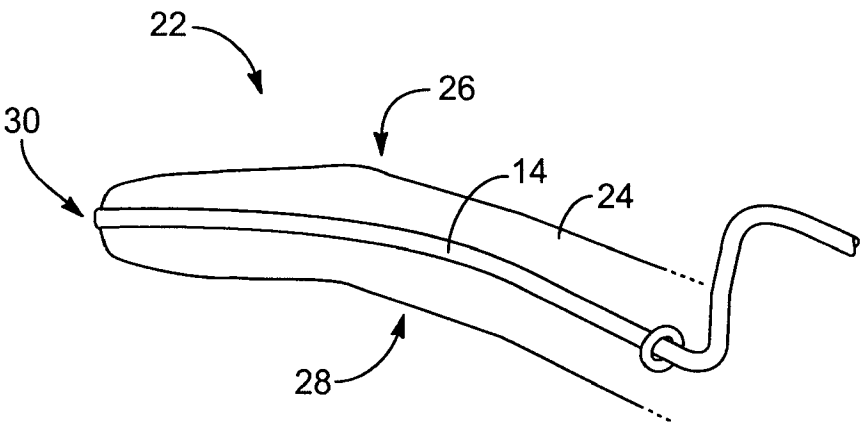
FIG. 2(*a*) depicts a similar representation as FIG. 1, but with the glove as transparent and the cords on the dorsal side of the user's hand. That is, FIG. 2(*a*) depicts an embodiment of the present invention wher the glove is transparent so that one only views the cords, and not the glove to which the cords are integrally connected.
Figure 2A:
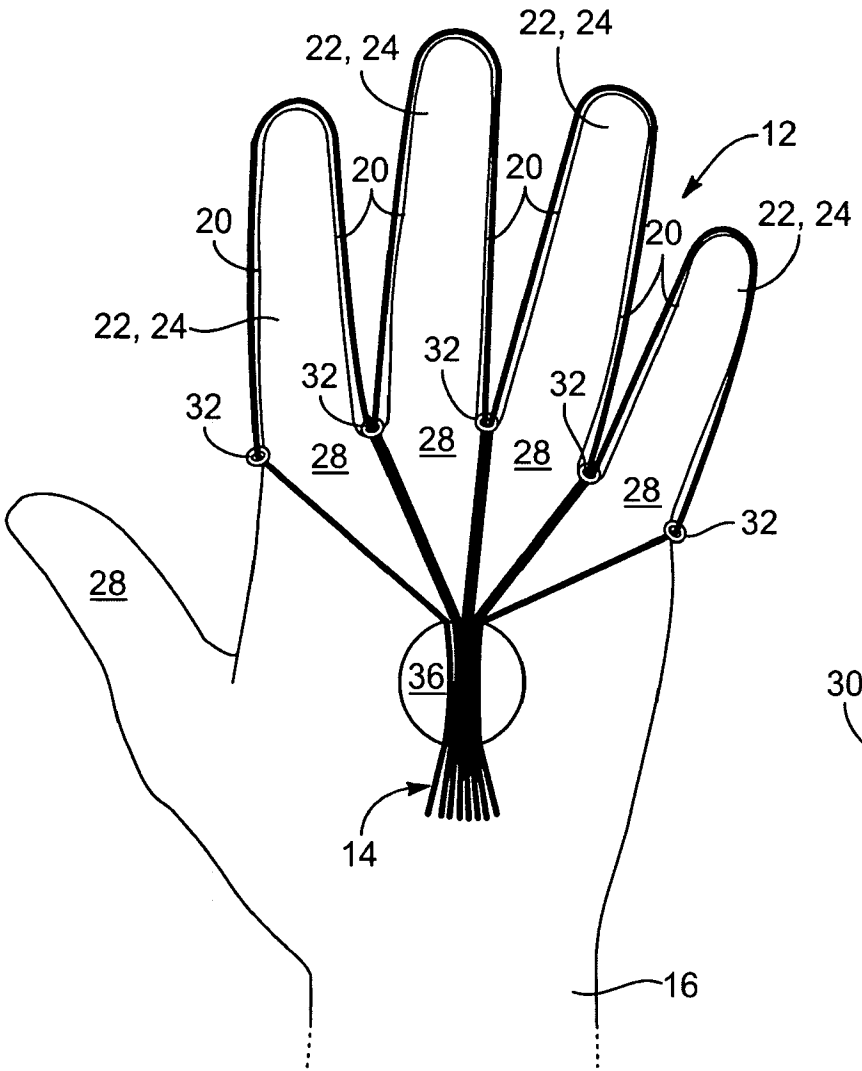

FIG. 2(*a*) depicts a similar representation as FIG. 1, but with the glove 10 as transparent and the cords 14 on the dorsal side of the user's hand. That is, FIG. 2(*a*) depicts an embodiment of the present invention where the glove 10 is transparent so that only the cords 14 are viewable, and not the glove 10 to which the cords 14 are integrally connected. This figure also depicts the dorsal side 13 of the user's hand 12. In contrast, the palmar side 11 is on the opposite side of the dorsal side 13 and is not viewable in this figure. In this embodiment, the cords 14 run bilaterally along the diametric sides 20 of finger compartments 22 that receive a user's finger 24. The cords 14 are integrally attached to the glove 10 at certain areas, but not at other areas. This will be more fully explained below. Moreover, the finger compartments 22 are part of the glove 10, and because the fingers 24 are substantially cylindrical, four different areas of the finger 24 will be identified and referred to in order to demonstrate where the cords 14 connect with the glove 10. These areas are best illustrated in FIG. 2(*b*).

FIG. 2(*b*) depicts a transparent side view of the user's finger 24 with the cord 14 running alongside. As mentioned above, the finger compartments 22 receiving the finger 24, which are transparent in this Figure, have four sides: a dorsal-region 26 that is on the same plane as the dorsal side 13 of the glove 10; a palmar-region 28, diametric sides 20; and a tip 30. The diametric sides 20 are, as their name suggests, opposite one another. Put another way, the diametric sides 20 are on the sides of the finger 24, which are not the dorsal-region 26 or the palmar-region 28.

Returning now to FIG. 2(*a*), the cords 14 that run alongside the diametric sides 20 of the finger compartments 22 may be connected to the glove 10 in a variety of ways. However, the way displayed in the embodiment shown in FIG. 2(*a*), depicts loop-shaped elements 32 that receive the cords 14 at the area where the cords 14 are not integrally connected to the diametric sides 20 of the glove 10. Specifically, the cords 14 run through these loop-shaped elements 32 at a region known as the metacarpophalangeal joint region 34. Though their name conveys otherwise, these loop-shaped elements 32 do not necessarily need to be circular, but shaped in a way as to enable the cylindrically-shaped cords 14 to move within them, relative to the glove 10. That is, the loop-shaped elements 32 enable the cords 14 to move back and forth within them. This motion enables the user to pull and release the cords, thereby enabling and releasing the grip, respectively.

Thus, in FIG. 2(*a*) the cords 14 are integrally connected to the glove 10 as they run longitudinally and bilaterally along the diametric sides 20 of the finger compartments 22. At the metacarpophalangeal joint region 34, though, the cords 14 become no longer integrally connected to the glove 10 and are received within the loop-shaped elements 32 where they (14)

are movable relative to the glove 10. The cords 14 are then congregated into a gathering and tightening feature 36. A user may then pull the cords 14, which forces the fingers 24 within the finger compartments 22 to curl toward the palm 48 of the glove 10 and thereby, to form a grip. The user may then secure the cords 14 by either activating the gathering and tightening feature 36 so that the tightening portion of the gathering and tightening feature 36 secures the cords. Alternatively, the cords 14 can be tied so that the grip is maintained. Other ways to secure the cords 14 may be used, such as by using clamps, fasteners, and any other device or mechanism (all of which may be incorporated into the gathering and tightening feature 36), which prevents the cords 14 from retreating back through the loop-shaped elements 32 and thereby, causing the grip to release.

Thus, as described in the background section, pulling the cords 14 and enabling the gathering and tightening feature 36 allows users desiring a prolonged grip, to have such a grip, yet relax their hand in the grip so as to not overuse muscles within the hand and forearm. Moreover, such a "forced" grip mitigates the potential for hand and muscle fatigue often associated with those sports activities or activities where users maintain a prolonged grip.

Figure 3:
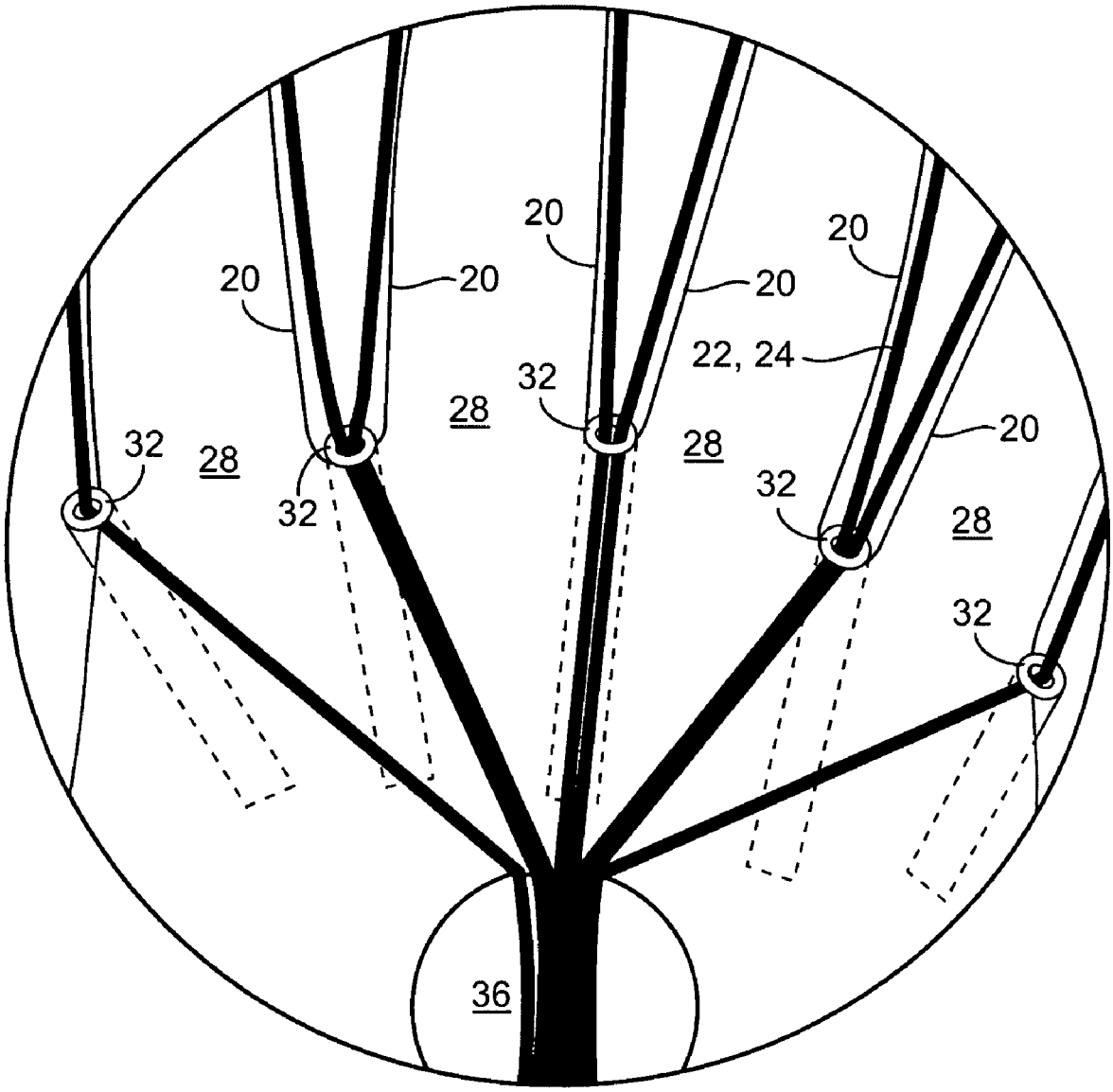
FIG. 3 depicts FIG. 2(*a*), again as if the glove was transparent. This figure, though, is a close-up of FIG. 2(*a*).

FIG. 3 depicts FIG. 2(*a*) again as if the glove was transparent. This figure, though, is a close-up of the loop-shaped elements 32 that integrally connect the cords to the glove and the gathering and tightening feature 36. Similarly to FIG. 2(*a*), in this embodiment, the cords 14 slide through the loop-shaped elements 32, with relative motion to the glove 10, when the user pulls the cords 14 so a grip is formed and secured.

Figure 4B:
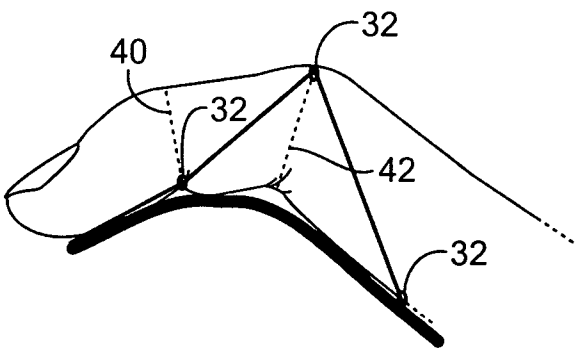
FIGS. 4(*a*) and (*b*) are other embodiments of the present invention.
Figure 4A:
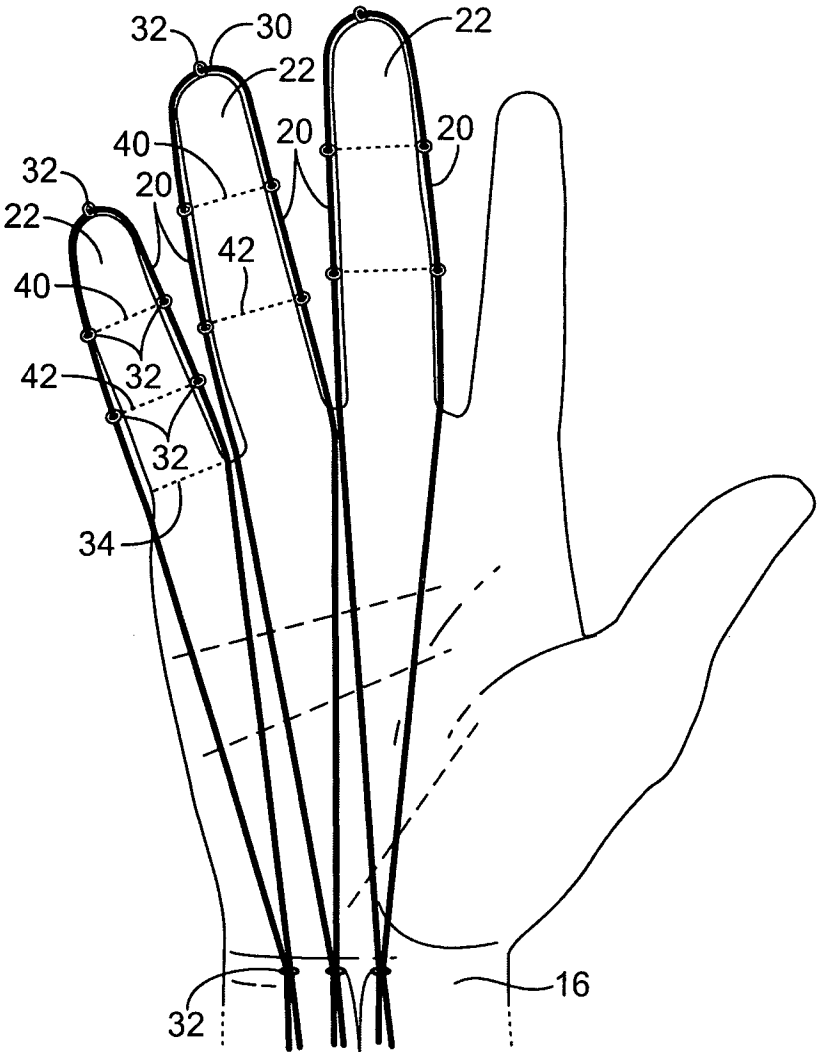

FIGS. 4(*a*) and (*b*), 5(*a*) and (*b*), and 6 depict other embodiments of the present invention that allow the user to maintain a grip. Specifically, 4(*a*) depicts an alternative embodiment of the present invention where the cords 14, unlike in FIGS. 2 and 3, do not gather at a gathering and tightening feature 36, but instead run through loop-shaped elements 32 located closer to the wrist 16. Similarly to FIGS. 2 and 3, the cords 14 run longitudinally and bilaterally along the diametric sides 20 of the finger compartments 22, but in this embodiment they are not integrally connected to the diametric sides 20 of the finger compartments 22. Rather, the cords 14 are able to move relative to the finger compartments 22 through loop-shaped elements that are interspersed along the finger compartments 22. In this specific embodiment, the loop-shaped elements 32 may be placed at the distal interphalangeal joint 40, the proximal interphalangeal joint 42, and perhaps even again at the metacarpophalangeal joint region 34. To optimize the way the cords 14 run through the loop-shaped elements 32 and to ensure that the cords 14 are sufficiently integrally connected with the glove 10, locations for the loop-shaped elements 32 are depicted in 4(*b*). FIG. 4(*b*) is a view of one diametric side 20 of a finger compartment 22 and illustrates possible locations for the loop-shaped elements 32 that receive the cords 14. For instance, one loop-shaped element 32 may be placed at the distal interphalangeal joint 40 on the palmar-side 28 of the finger compartments 22, while another is at the dorsal-side 28 of the finger compartments 22. Yet another can be placed at the metacarpophalangeal joint region 34 on the dorsal side 13. Similarly, the foregoing placement of the loop-shaped elements 32 would be at the other diametric side 20 of the same finger compartment 22. Also shown in 4(*a*) and 4(*b*) are loop-shaped elements 32 found at the tip 30 of the finger compartment 22.

Again, in FIG. 4(*a*) rather than the cords being integrally connected along the diametric sides 20 of the finger compartments 22, the cords 14 are able to move relative to glove 10 and the finger compartments 22. The loop-shaped elements 32 are also found near the wrist 16, showing how in various embodiments of the present invention the cords may be longer or shorter depending on the placement of the gathering and tightening feature 36. FIG. 4(*a*) shows the gathering and tightening feature 36 would be located below the loop-shaped elements 32 and below the wrist 16.

In all the above embodiments, the cord 14 may be exposed on the outside of the glove 10, located within the glove 10, or layered between two pieces of fabric integrally connected to the glove 10. Again, the cords 14 may be integrally secured to the diametric sides 20 of the finger compartments 22 or unconnected so that they may move relative to the finger compartments 22.

Figure 5B:
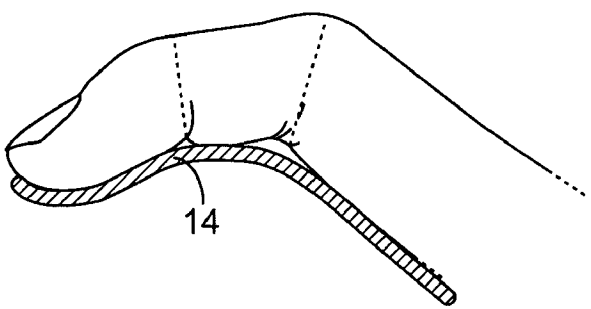
FIGS. 5(*a*) and (*b*) are even other embodiments of the present invention.
Figure 5A:
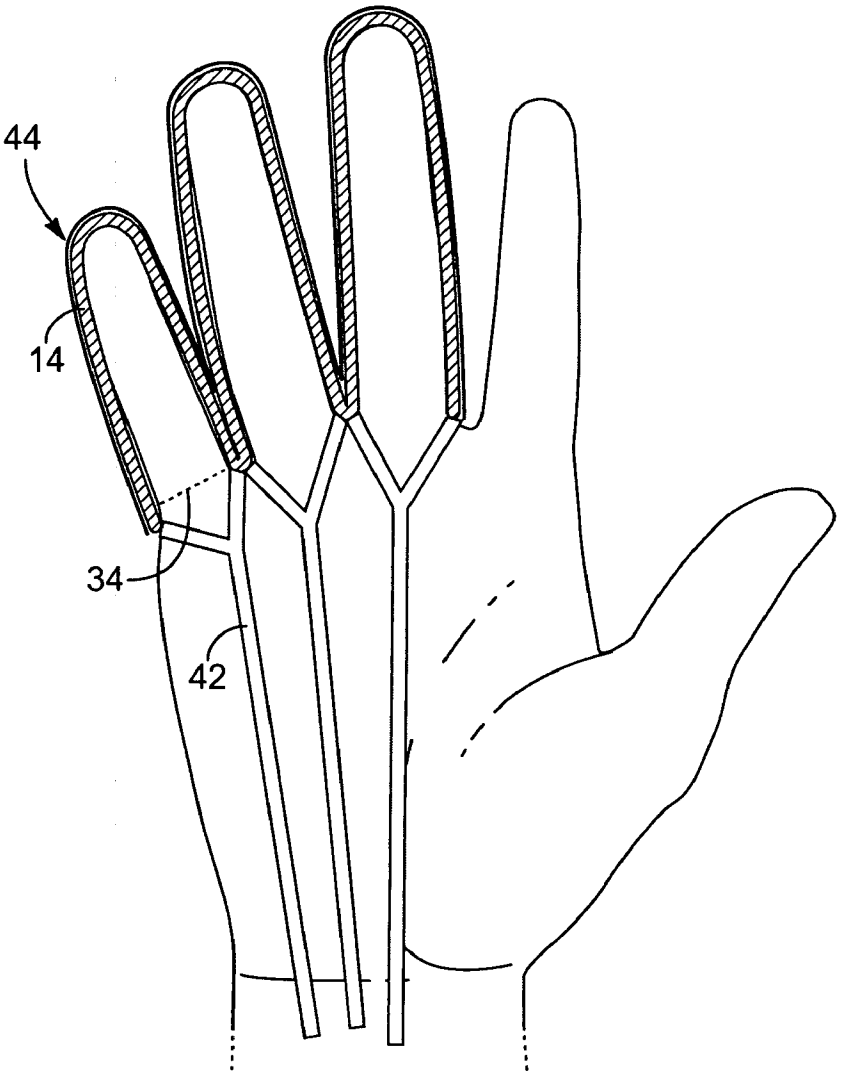

Another embodiment is shown in FIG. 5(*a*). In this Figure, the cords 14 connect after the metacarpophalangeal joint region 34 to form one combined cord 42 that then runs to a gathering and tightening feature 36. Again in this figure, the cord 14 may be covered by stitches 44 that help integrally connect the cords to the finger compartments 22. FIG. 5(*b*) is a profile view of 5(*a*).

In other embodiments not shown in figures, the gathering and tightening feature 36 might be activated by a hydraulic piston.

Figure 6:
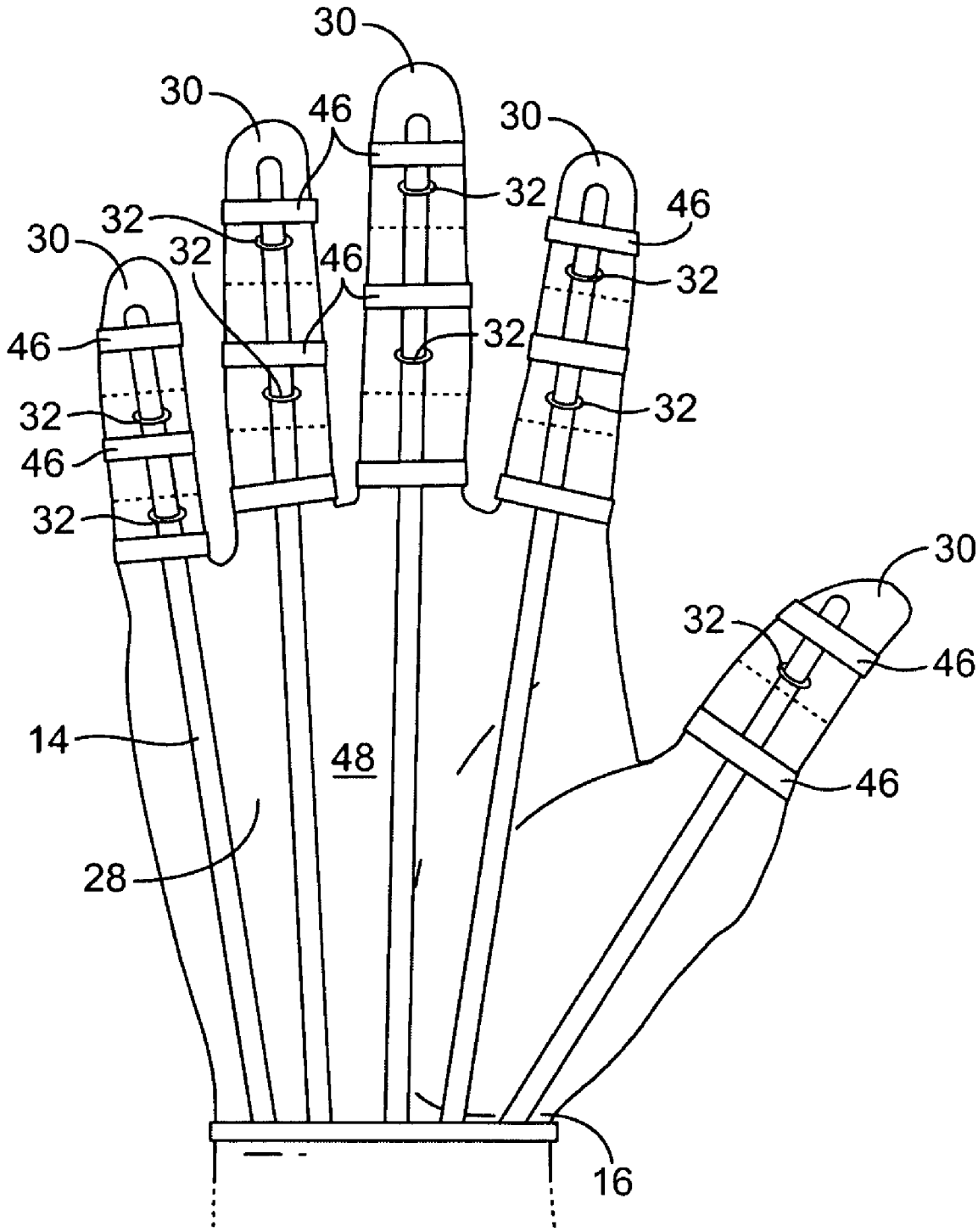
FIG. 6 is yet another embodiment of the present invention.

FIG. 6 depicts another embodiment of the present invention. Similarly to FIG. 2, this depiction makes the glove transparent so only the cords are viewable. FIG. 6 displays the cords 14 running alongside the palmar-region 28 of the finger compartments of the palmar side 11 of the glove 10. That is, the cords 14 are not on the diametric sides 20, or bilaterally placed on the finger compartments 22, but rather, run along the palmar-side 28 of the finger compartments 22. The loop-shaped elements 32 are also placed differently. Similarly to the cords 14, in this embodiment, they run in vertical alignment with the finger compartments 22. The cords are secured by horizontal straps 46 that are received by the loop-shaped elements 32. The horizontal straps 46 run from one diametric side 20 to the other 20 so they can be received within the loop-shaped elements 32 in order to help integrally connect the cords 14 to the finger compartments 22. The cords 14 in this embodiment run from below the tip 30, or even on the tip 30, vertically downward toward and below the wrist 16. They are not attached at the palm 48, but rather, around the wrist 16, so that they may be pulled by a user to draw the finger compartments 22 down and force the glove 10 into a grip.

Figure 7A:
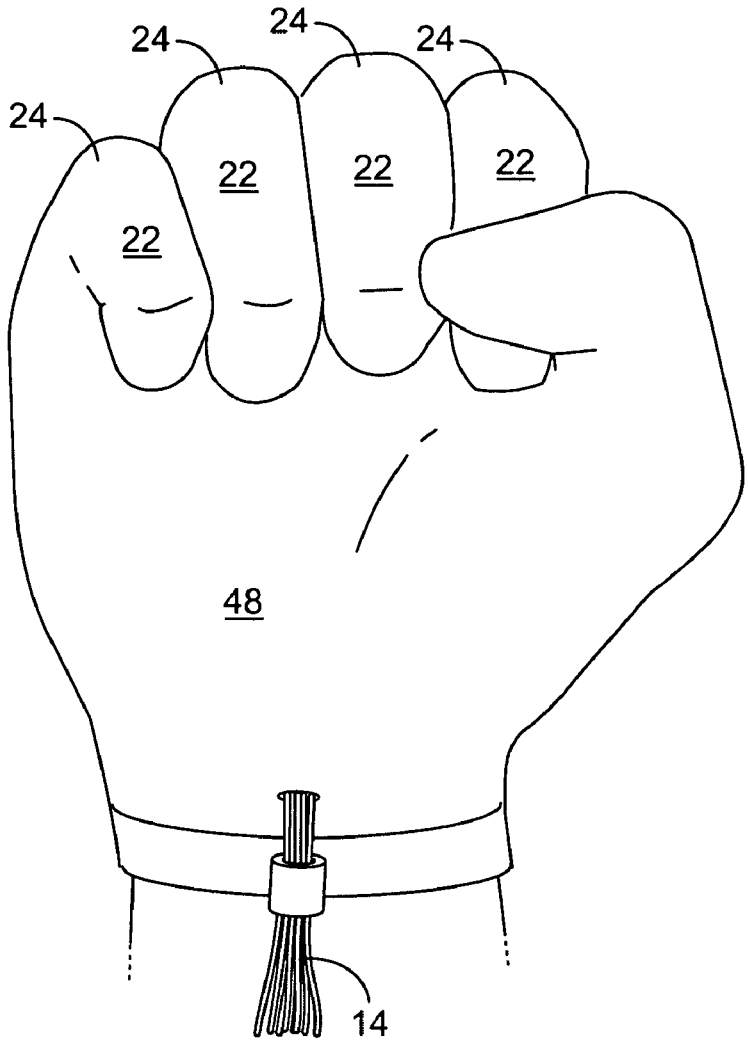
FIGS. 7(*a*), (*b*) and (*c*) depicts the embodiment represented in FIG. 1, but in a gripped position.
Figure 7B:
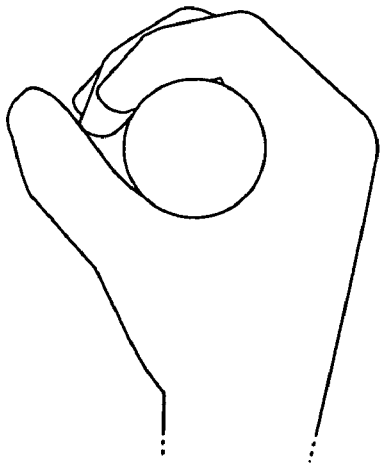
Figure 7C:
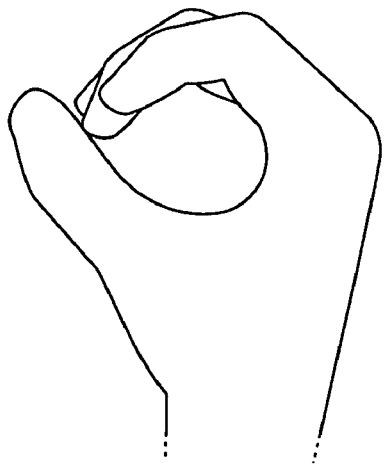

FIG. 7(*a*) depicts the embodiment represented in FIG. 1, but in a gripped position. That is, in this Figure, the user's hand is contracted inward and the fingers 24 (and corresponding finger compartments 22) are pulled toward the palm 48 resulting in a grip. The present invention, therefore, enables a user to maintain a gripped position, without having to heavily rely on the hand and arm muscles to maintain the grip. FIGS. 7(*b*) and 7(*c*) depict two side views of the user's hand in the glove: 7(*b*) depicting the hand gripping a cylindrical object while 7(*c*) depicts the hand in gripping position without the cylindrical object.

Figure 8A:
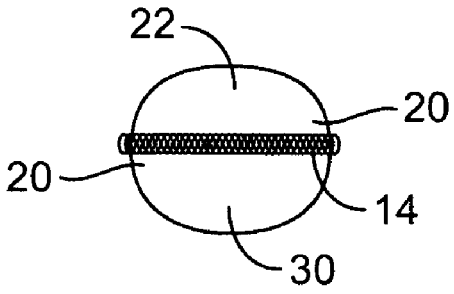
FIG. 8(*a*) shows a top view of one embodiment of the present invention while FIG. 8(*b*) shows the top view of another embodiment.
Figure 8B:
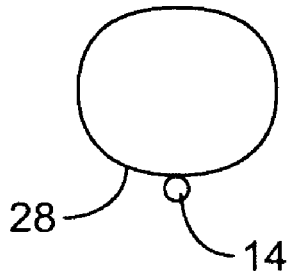

FIG. 8(*a*) shows a top view of one embodiment of the present invention displaying the tip 30 of the finger compartment 22 with the cord 14 running along the tip 30 and along the diametric sides 20 of the finger compartment 22. This is the embodiment depicted in FIG. 2. FIG. 8(*b*) shows an alternative embodiment where the cord 14 aligns the palmar-side 28 of the finger compartments 22 (not shown.)

Figure 9A:
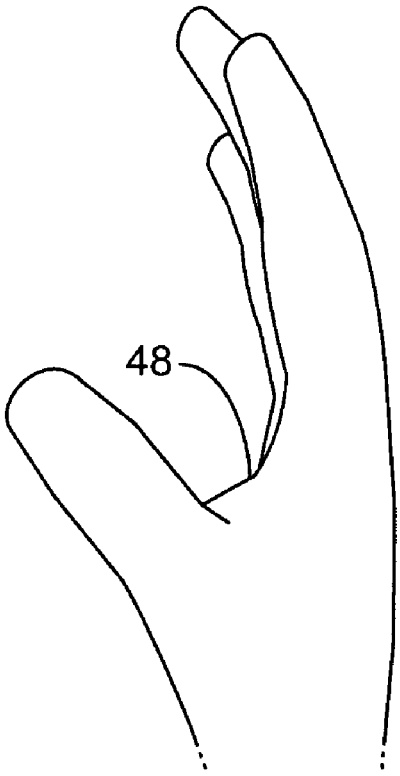
FIG. 9 shows to positions of the embodiments of the present invention herein disclosed.
Figure 9B:
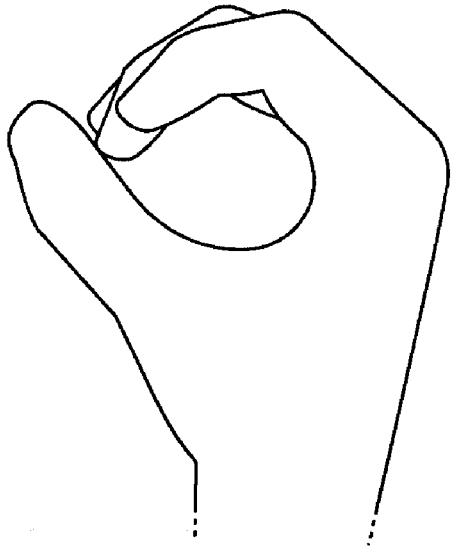

FIG. 9 shows two positions of the embodiments of the present invention herein disclosed. In position (a) the glove 10 is in the initial position, where the fingers of a user are protruded and extended and the palm 48 is opened and flat.

Position (b) demonstrates the cords 14 having been pulled by the user and thereby, creating a grip. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A glove comprising:

a hand-receiving area;

a dorsal side;

a palmar side;

at least one finger compartment for receiving a user's finger, wherein each of at least one of the finger compartment has four sides, each finger compartment comprising:

a dorsal-region that is in the same plane as the dorsal side of said glove;

a palmar-region that is in the same plane as the palmer side of the glove;

two diametric side regions;

a tip;

at least one cord disposed on one of the two diametric side regions of the at least one finger compartment, the finger compartment being integrally connected with the glove, wherein said at least one cord is bilateral and longitudinal with respect to said at least one finger compartment and runs along said two diametrical side regions of said at least one finger compartment and along said tip, which is integrally connected with said glove; and a gathering and tightening feature on the dorsal side of the glove that gathers the at least one cord and enables the user to pull the cord so that the finger compartment may be drawn inwardly toward the palmer side to form a grip of the glove.

2. The glove of claim 1, wherein said gathering and tightening feature on said dorsal side of said glove gathers each of said at least one bilateral, longitudinal cord and enables said user to pull said at least one bilateral, longitudinal cord so that a thumb compartment and said finger compartment may be contracted to form said grip of said glove.

3. The glove of claim 1, wherein loop-shaped elements receive said at least one cord and enable the user to pull said at least one cord therethrough.

4. A glove comprising:

a dorsal side;

a palmar side;

a plurality of compartments for receiving a user's finger, wherein each of said finger compartments have two diametric side regions, a tip, a dorsal-region and a palmar-region;

a plurality of cords, each of the cords extending longitudinally along a majority of at least one of said two diametric side regions of each of the plurality of finger compartments; and a gathering and tightening element that gathers said cords, contains said cords and enables said user to pull said cords so that said finger compartments contract to form a grip, wherein the gathering and tightening element enables a user to secure said cords and precludes said cords from releasing such that the grip is relaxed.

5. The glove of claim 4, wherein loop-shaped elements receive said cords and enable the user to pull said cords therethrough.

6. The glove of claim 4, wherein said gathering and tightening element is located on said dorsal side of said glove.

7. The glove of claim 4, wherein said gathering and tightening element is located on said palmar side of said glove.

8. A glove comprising:

a dorsal side;

a palmar side;

at least one finger compartment for receiving a user's finger, wherein the finger compartment has two diametric side regions, a tip, a dorsal-region and a palmar-region;

a cord that runs longitudinally along at least one of the two diametric side regions of the at least one finger compartment and extends across the tip of the finger compartment; and a gathering and tightening feature that gathers the cord, contains the cord and enables the user to pull the cord so that the finger compartment contracts to form a grip.

9. The glove of claim 8, wherein loop-shaped elements receive the cords and enable the user to pull the cords therethrough.

10. The glove of claim 8, wherein the gathering and tightening feature is located on the dorsal side of the glove.

11. The glove of claim 8, wherein the gathering and tightening feature is located on the palmar side of the glove.

12. A glove comprising:

a dorsal side;

a palmar side;

a plurality of compartments for receiving a user's finger, each of the finger compartments having two diametric side regions, a tip, a dorsal-region and a palmar-region;

at least one cord, the cord extending along a majority of at least one of two diametric side regions of at least one finger compartment, the cord being adjustable to increase tension of the cord, thereby causing the at least one finger compartment to move toward the palmar side and to decrease tension of the cord, thereby causing the at least one finger compartment to extend away from the palmar side; and a fastener to secure the cord at a desired tension, wherein the fastener enables a user to secure the cord and precludes the cord from releasing such that tension of the cord remains increased.

* * * * *